United States Patent [19]

Okazaki

[11] 3,935,801

[45] Feb. 3, 1976

[54] APPARATUS FOR MANUFACTURING SPIRAL TUBES

[76] Inventor: Kakumichi Okazaki, 4-15, Zuiko-dori, Higashiyodogawa, Osaka, Japan

[22] Filed: Nov. 8, 1973

[21] Appl. No.: 414,059

[52] U.S. Cl. ..... 93/80; 93/77 R; 156/432

[51] Int. Cl.² ..... B31C 3/00

[58] Field of Search ..... 93/80, 77 R, 83; 156/432, 156/425

[56] References Cited

UNITED STATES PATENTS

| | | | |
|---|---|---|---|
| 1,941,993 | 1/1934 | Minton | 93/80 |
| 3,150,574 | 9/1964 | Glasby | 93/80 |
| 3,354,800 | 11/1967 | Sato | 93/80 X |
| 3,460,445 | 8/1969 | Ried | 93/80 |
| 3,538,817 | 11/1970 | Brown | 93/80 |

*Primary Examiner*—Roy Lake
*Assistant Examiner*—James F. Coan
*Attorney, Agent, or Firm*—Allison C. Collard

[57] ABSTRACT

Improved apparatus for manufacturing spiral tubes wherein two portions of a spiral tube in the process of covering a mandrel are wound and pressed in opposite directions alternately by means of two belts which are so arranged that they satisfactorily wind and press the spiral tube without causing the mandrel to lean in any direction, and that the two portions wound and pressed by the two belts do not overlap one even when the two portions shift naturally, and a cutting device is so arranged that it cuts the spiral tube easily and smoothly.

1 Claim, 10 Drawing Figures

APPARATUS FOR MANUFACTURING SPIRAL TUBES

OBJECT OF THE INVENTION

An object of this invention is to manufacture a spiral tube firmly starched by being wound and pressed by two belts.

Another object of this invention is to provide a spiral tube which can smoothly advance to a cutting device without causing a mandrel to lean to any direction so as to be cut efficiently.

A further object of this invention is to provide a device which does not allow the two spiral-tube portions wound and pressed by the two belts to overlap even when these portions are shifted by the effects of others during the winding and pressing operation, and thereby does not cause any trouble in operation.

A still further object of this invention is to obtain a straight and strong spiral tube by placing the two wound and pressed portions by means of the two belts as closely as is necessary.

A fifth object of the invention is to provide an apparatus of good performance which is capable of manufacturing spiral tubes with an inner diameter as small as about 1 millimeter.

There have hitherto been many kinds of machines which supply tape-type paper materials obliquely from their both sides to the surface of this kind of a mandrel, and wind and press them to manufacture spiral tubes.

In one type of machine, with one belt which starches and winds and presses a spiral tube in the process from outside, there occurs an imperfectly starched portion because of insufficient winding and pressing, thereby lowering the value of the product. Besides, in the winding and pressing process, the mandrel is pulled in one direction by the belts, thereby causing both the mandrel and the processed spiral tube to bend in that direction. Thus, with this type of machine it is difficult not only to obtain a straight article but also to advance the spiral tube directly to a cutting device so as to be cut therewith.

In another type of machine with two belts so arranged that their winding and pressing directions are the same, the starching conditions are considerably better because their winding and pressing operations are performed twice. But in this case, the mandrel and the spiral tube are pulled twice in that direction, and so they tend to be curved in that direction, which causes the advancing direction of the spiral tube to deflect in that direction. This interferes with the smooth introduction of the spiral tube into a cutting device in the next step. Thus, this type of machine has also a serious defect.

U.S. Pat. No. 1,941,993 of Jan. 2, 1934, to Minton, discloses an apparatus and a mechanism for manufacturing spiral tubes, wherein one belt is arranged in such a way that one portion to be wound and pressed by the belt is just opposite another portion to be wound and pressed by the same belt, and that these two portions cross over the mandrel and the spiral tube in the process. Admittedly this type of machine eliminates such defects as the bending and the deflection of the spiral tube, and shows a quite excellent starch fixation because of the satisfactory winding and pressing. However a shocking contact of the cutting device in the next step leads to a momentary shifting of the portions wound and pressed by the belt. As the two portions cross near each other, this machine has a serious defect in that the two tube portions overlap. The overlapping of the two portions, travelling in opposite directions, interferes with the smooth movement of the belt, and sometimes leads to the suspension of its operation. As this type of machine has such a serious defect, it has not yet been put into practical application.

In the present invention, two belts, the winding directions of which are opposite to each other, are so arranged that they cross at a place other than the two tube portions to be wound and pressed by the two belts. Thus, starching portions can be firmly fixed by two winding and pressing operations.

What is more, as the spiral tube is wound and pressed in the opposite directions alternately, the pulling forces of the two belts are directed in opposite directions so that these forces equalize each other.

Thus, the spiral tube formed is a good and straight article. Furthermore, the spiral tube advances smoothly, without deviating from its advancing direction. Even though the portions being wound and pressed by the belts are momentarily shifted by the contact of a cutting blade arranged to be connected directly, the belts do not overlap at such portions, because the two belts wind and press the spiral tube at different places, and do not cross over the mandrel and over the spiral tube formed.

Thus, the equipment of this invention does not cause suspensions of operation as in the case with the cited U.S. patent, performs a satisfactory winding and pressing operation in any respect, allows the spiral tube to advance smoothly to the cutting device, and manufactures good quality products efficiently.

What is more, on account of the winding and pressing in opposite directions alternately as has been described hereinabove, the equipment of this invention efficiently prevents the bending of a spiral tube and its deflection while being manufactured, and so is capable of manufacturing small spiral tubes with diameters as small as 1 mm. The apparatus is conveniently employed in continuously insulating many individual wires contained in insulated covers, or envelopes.

BRIEF DESCRIPTION OF DRAWINGS

The accompanying drawings show a preferred, exemplary embodiment of the invention, wherein

FIGS. 6 and 8 are sectional views of a tube winding portion wherein

FIG. 6 is a winding portion of the processed tube by a first belt constituting a section taken along lines 6—6 in FIG. 1 and seen from the parallel direction to the advancing direction of the spiral tube, and FIG. 8 is a section taken along lines 8—8 in FIG. 1, respectively.

DETAILED DESCRIPTION OF THE INVENTION

Figure 1:
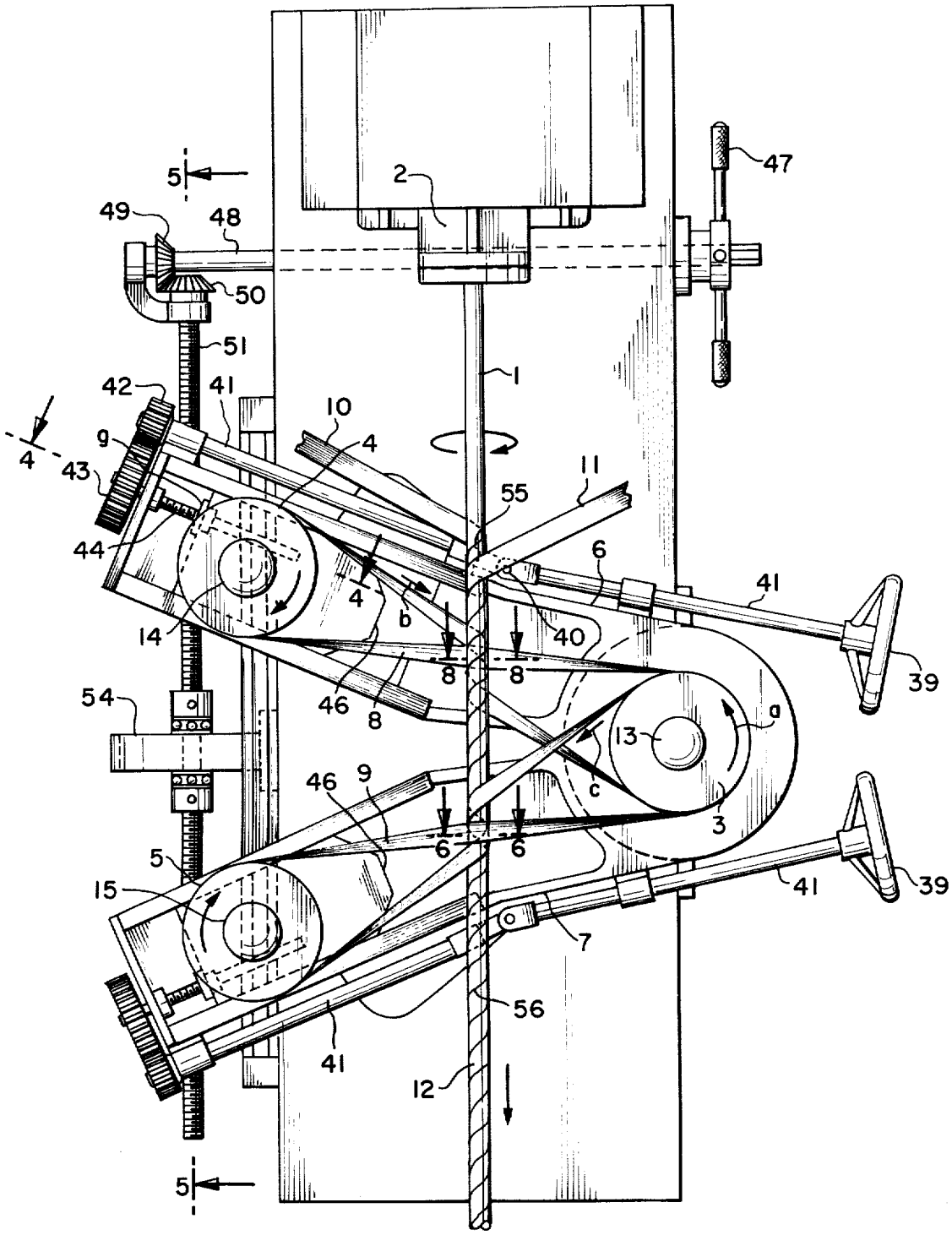
FIG. 1 is a plan view of the apparatus embodying this invention.

Referring now to the drawings, the inventive, exemplary apparatus comprises a mandrel 1 with one end fixedly supported in a frame 2 and the other end free, about which a tube 12 is being processed, as will be described. There is a first pulley 3 provided on one side of the mandrel 1. The pulley 3 rotates in a direction of arrow a by being connected to a power source at a lower place. There is a rotating shaft 13 for the first pulley 3. A second pulley 4 is supported by a rotating shaft 14 at the tip of a control arm 6 to which the lower end of the shaft 13 is attached. The second pulley 4 rotates by means of the shaft 13 and a transmission gear to be described later. A third pulley 5 is supported by a rotating shaft 15 at the tip of a control arm 7 to which one end of the shaft 13 is attached. The lower end of the third pulley 5 rotates by means of the shaft 13 and a transmission gear to be described hereinbelow. A first belt 8 extends from the first pulley 3 to the second pulley 4, which belt in the center goes around the mandrel 1 and the spiral tube 12 being processed, in a "b" arrow direction.

A second belt 9 extends from the first pulley 3 to the third pulley 5, and which belt in the center also goes around the mandrel 1 and the spiral tube 12 but in a direction opposite to the arrow "*b*", as shown by an arrow "*c*". An inner winding paper is shown at 10, and an outer winding paper material at 11, both of which are in a tape form. They are respectively starched at will, and at an oblique angle, depending upon the diameter of the paper tube 12 and the width of the tape, they wind over the surface of the mandrel 1 overlapping each other.

A spiral overlapped portion 55 of the inner winding paper material 10 is covered in the midway of the tape width of the outer winding paper material 11, and the middle portion of the tape width of the inner winding paper material 10 is placed in contact with the back of a spiral overlapped portion 56 of the outer winding paper material 11. These factors enable one to manufacture the strong paper tube 12.

Figure 2:
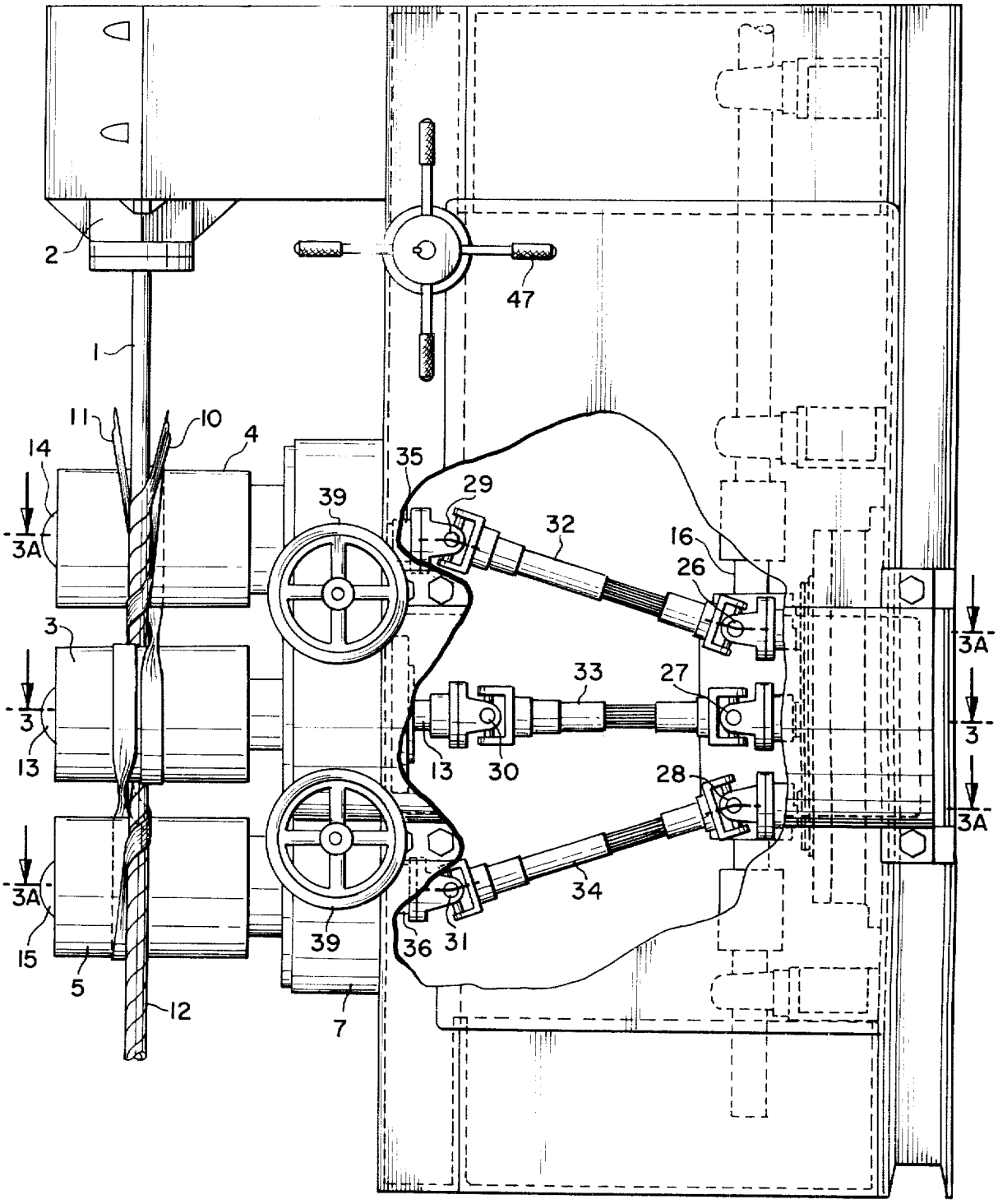
FIG. 2 is a front view of the apparatus.
Figure 3:
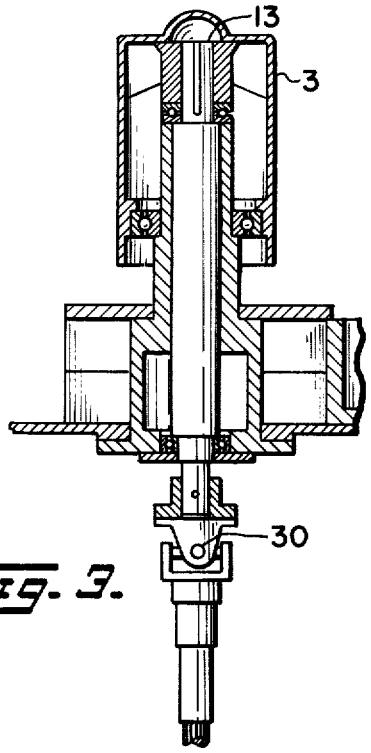
FIGS. 3, 3A and 3B are sectional views of a fragmental portion showing a transmission device, the upper left hand side being a section taken along the line 3—3 in FIG. 2, and the upper right hand side is a section taken along the line 3A—3A in FIG. 2, while the lower side is a section taken along the line 3B—3B in FIG. 7.
Figure 3A:
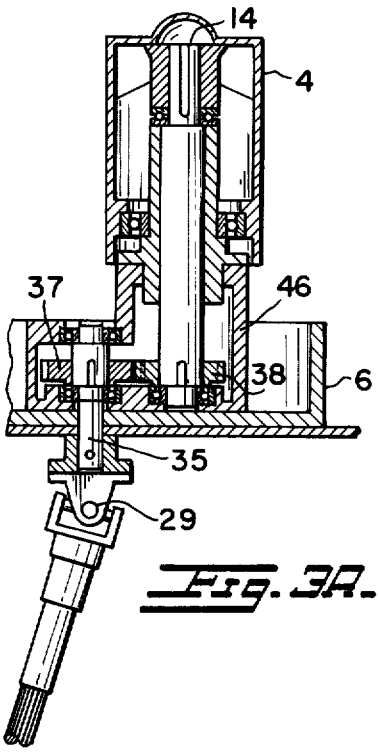
Figure 7:
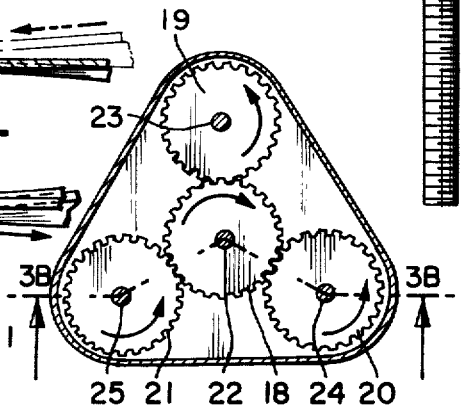
FIG. 7 is a sectional view of a portion of the transmission device taken along the line GG in FIG. 3.

Referring mainly to FIGS. 2, 3, and 7, a transmission device is now described. A main shaft 16 allows a main gear 18 to rotate by means of a bevel gear 17. The rotation of the main gear 18 leads to the rotation of three gears 19, 20, 21, all in the same direction. The three gears are provided in three directions about the main gear 18; the gear 19 rotates the shaft 13; the gear 20, the shaft 14; and the gear 21, the shaft 15.

Numerals 22, 23, 24, 25 are driving shafts of the gears 18, 19, 20, 21, respectively. Numerals 26, 27, 28 are lower universal joints, respectively, and numerals 29, 30 31 are upper universal joints, respectively. Numerals 32, 33, 34 are spline shafts whose lower ends are connected with the driving shafts 23, 24, 25 through the lower universal joints 26, 27, 28, respectively.

The upper ends of the spline shafts 32, 34 are connected with linking shafts 35, 36, respectively, through the universal joints 29, 31, respectively, while the upper end of the spline shaft 33 is connected with the shaft 13 through the upper universal joint 30. The upper ends of the linking shafts 35, 36 are connected with the lower ends of the shafts 14, 15, respectively, through gears 37, 38 so as to move together.

As has been described hereinabove, the shaft 14 is connected with the spline shaft 32 through the gears 37, 38, and in the same mechanism the shaft 15 is connected with the spline shaft 34 through gears, whereas the shaft 13 is directly connected with the spline shaft 33. Thus, the pulley 3 rotated by the shaft 13, the pulleys 4, and 5 rotated by the shafts 14, 15, respectively will rotate in opposite directions to each other. Consequently, both the pulley 4 and the shaft 13, and both the pulley 5 and the shaft 13, are able to be connected and rotated by the belts 8, 9, respectively.

It should be understood from the preceding portion of the description that the belts 8, 9 constitute separate units, as can be seen in FIGS. 1 and 2, with their respective pulleys 4, 5; control arms 6, 7; and the subsequently described operative parts 14, 15; 20, 21; 24, 25; 26, 28; 29, 31; 32, 34; 35, 36; etc. Each of these units has one of the tension varying or control devices associated therewith, as will be described hereinafter.

Figure 4:
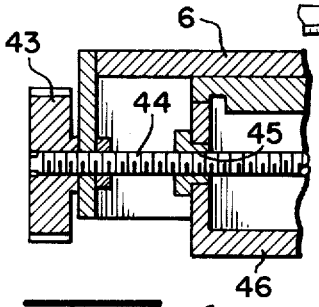
FIG. 4 is a sectional view of a belt tension control device taken along the line 4—4 in FIG. 1.
Figure 8:
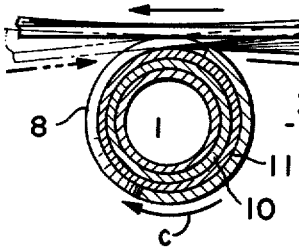

Next, referring mainly to FIGS. 1 and 4, a tension varying or control device for the belts 8, 9 for winding and pressing respective tube portions will now be described. A tension control handle 39 is fixed on the front end of a connecting rod 41. The central part of the rod 41 is connected to a universal joint 40. A gear 42 is fixed on the rear end of the rod 41. A transmission gear 43 meshes with the gear 42. A bolt 44 constitutes the shaft of the gear 43 and is movably fitted into the control arms 6, 7, and also movably fits in a tension control member 46 through a bolt hole 45.

The shaft 14 is movably fitted into the member 46, and to the shaft 14 is attached the shaft 35 which rotates by means of the gears 37, 38. What is more, the shaft 15 is also movably fitted into member 46, and to this shaft, similar to shaft 35, 15 is attached a linking shaft which rotates by means of the gears 37, 38. By the backward or forward transfer of the tension control member 46, the distance between the first and second pulleys 3, 4, or between the first and third pulleys 3, 5, may be suitably controlled. Thus, the tension of the first or the second belt 8, 9 may be suitably controlled.

Figure 5:
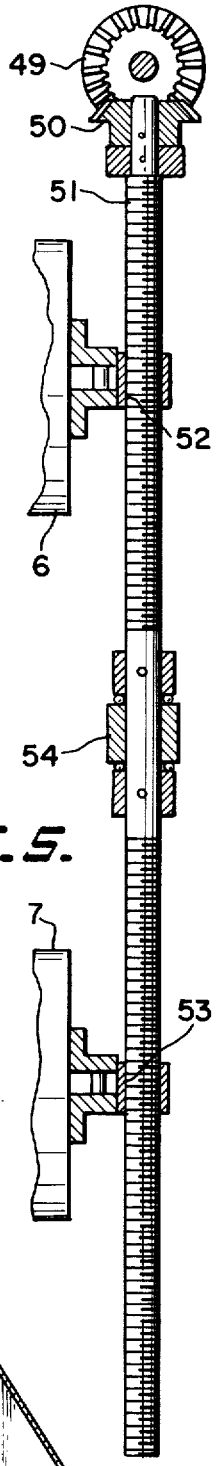
FIG. 5 is a sectional view of a belt angle control device taken along the line 5—5 in FIG. 1.
Figure 3B:
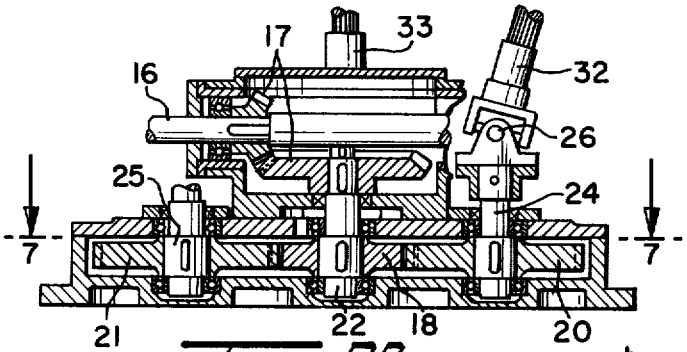
Figure 6:
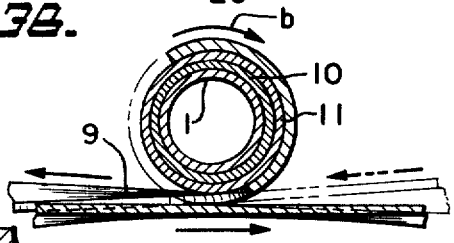

Next, referring mainly to FIGS. 1 and 5, a belt angle control device will now be described. An angle control handle 47 is fixed at the front end of a straight rod 48. A bevel gear 49 is fixed at the rear end of the straight rod 48. A bevel gear 50 works with the bevel gear 49, and a bolt a threaded rod 51 acts as a shaft of the gear 50. At the lower ends of the control arms 6, 7 there are bolt holes 52, 53 in which the bolt 51 fits. The numeral 54 is a bearing member. The spiral direction on one side of the bearing member 54 is just opposite to that on the other side thereof.

If the handle 47 is held and allows the bevel gear 49 to rotate, then the bevel gear 50 is made to rotate, which leads to the rotation of the bolt 51, and thereby the control arms 6, 7, supported by the bolt holes 52, 53, respectively, are allowed to move towards to each other or further away from each other.

Thus, when the arms 6, 7 are fixed at predetermined angles, the relative angle between the belts 8, 9 will be ultimately determined.

As has been described above, this invention is provided with the belt angle control device which can change the relative angle, and with the device which can adjust the distance between the first and second pulleys 3, 4, and between the first and third pulleys 3, 5. With these devices, therefore, this invention can make the desired adjustments concerning the operation of the inventive apparatus.

In operating the inventive apparatus, the paper materials 10, 11 are fed to the mandrel 1 from two opposite directions. Their angles with respect to the mandrel are made equal. The materials 10, 11 are so arranged that there remains some difference between their tape widths when they are fed into the space between the tube portions to be wound by the first belt 8 and the mandrel 1. As the belts 8 and 9 are allowed to rotate in the respective arrow directions, the first winding and starching operation is made by the first belts 8, followed by the second pressing and fixing, effected by the second belt 9.

The manner of winding of the materials 10, 11 on the mandrel 1 by the belts 8, 9 is in opposite directions. Thus, the first belt 8 tends to bend the mandrel in a plus direction while the second belt 9 in the opposite or minus direction, by the same amplitude, so that the processed spiral tube 12 and the mandrel do not ultimately bend in any direction. The spiral tube 12 advances in a straight direction to a cutter member (not shown) provided in the straight direction, to be cut easily and rationally in a desirable manner as expected.

As has been described above, the spiral tube does not ultimately bend in any direction, and so it is unlikely that a deflection is produced. Thus, it is possible not only to manufacture good spiral tubes but also to manufacture spiral tubes with an inside diameter as small as 1 mm.

Preferably, the portions of the spiral tube to be wound and pressed by the belts 8, 9 in the two directions are at a certain distance from each other so as not to overlap but yet as near as possible. The reasons for this is as follows: If the two tube winding and pressing portions are in such close proximity to each other as to make the mandrel and the processed spiral tube to intersect, as in the case of the earlier-mentioned U.S. patent, the contact by the blades for cutting the spiral tube will cause a movement or displacement of the two winding and pressing portions, and thereby cause an overlap of one over the other.

If the two tube winding and pressing portions overlap, that have opposite winding directions, it is impossible for them to advance, causing a serious trouble in the operation. It is necessary, therefore, that the two winding and pressing portions be located at a certain distance from each other at which they are not allowed to overlap by such external forces as has been described above.

In the event of the two tube winding and pressing portions being located at too great a distance from each other, the starch of the spiral tube, pulled in a slightly curved form in the "plus" direction and formed by the first belt, will be practically dry and set by the time the second belt winds and presses the spiral tube. Thus, the spiral tube is then wound and pressed while being pulled in the opposite or minus direction when the starch has practically dried. Thus, the excessive distance would have the defect in that it not only produces a tube portion imperfectly fixed by the starch, but also prevents the formation of a strong spiral tube.

In order to locate the tube portions to be wound and pressed by the two belts possibly near to each other, yet in such a way that they are not allowed to overlap, the two belts should not be placed parallel to each other, but have to be placed to intersect as is the case with the belts 8, 9 of this invention.

In manufacturing spiral tubes, one can manufacture them in any size by using a winding paper material in tape form having the desired width. But the angle at which the paper winding material is fed should be varied in proportion to of its width. The variation in this feeding angle makes it necessary to vary the winding and pressing angle at the tube portion to be wound and pressed by the belts. In order to do so, this inventive apparatus is provided with the control arms 6, 7 which support the second and third pulleys 4, 5 at their tips. By adjusting the relative angles of the arms 6, 7 by means of the angle control device, the winding and pressing angle can be easily changed. Besides, in order to adjust the belt pressure and tension at the winding and pressing portion, the inventive tension control device is provided.

In practising this invention, the speed of the tube portion to be wound and pressed by the first belt should be practically the same as far possible, as that by the second belt. In order to do so, the rotations of the first, second and third pulleys are synchronized with one another by means of the transmission device, as described.

As has been described above, this invention has excellent results that are beyond the achievements of conventional or known devices, and has succeeded in producing quality products very efficiently.

What is claimed is:

1. The apparatus for manufacturing continuous lengths of spiral tubes wound with at least two tape-like materials, the apparatus comprising in combination:

a mandrel;

two belts supported for running along two separate paths crossing at angles and spaced from each other;

means for driving said belts, including a common driving pulley, and separate take-up pulleys for said belts;

means for covering the processed spiral tube with said material, and for pressing the latter and said mandrel into tight engagement at two spaced-apart portions of said mandrel; said belt paths having respective forward and return runs between said common pulley and the respective take-up pulleys, one run of each belt constituting an active run in said pressing means; said mandrel portions having trained therearound, respectively from below and from above, one convolution of the active forward run of one belt and another convolution of the active return run of the other belt, thereby imparting to said mandrel pressing forces in the same circumferential direction at both said mandrel portions although pulling forces result in the oppositely moving active runs of said belts;

means for adjusting the angles of said belts relative to the axial direction of said mandrel and the spiral tube being formed thereon; said adjusting means including a threaded rod having two sections with oppositely directed threads thereon;

control arms movable along said sections, which arms respectively support said take-up pulleys; and means for rotating said threaded rod, thereby to adjust said relative angles of the belts.

* * * * *